US011021218B1

(12) United States Patent
Blocker et al.

(10) Patent No.: US 11,021,218 B1
(45) Date of Patent: Jun. 1, 2021

(54) APPARATUS AND METHOD TO AID WATER SPORT BOARD MANEUVERS

(71) Applicants: Robert Ray Blocker, Mountain Green, UT (US); Raelene Ehlers Blocker, Mountain Green, UT (US); Weston Robert Blocker, Mountain Green, UT (US)

(72) Inventors: Robert Ray Blocker, Mountain Green, UT (US); Raelene Ehlers Blocker, Mountain Green, UT (US); Weston Robert Blocker, Mountain Green, UT (US)

( * ) Notice: Subject to any disclaimer, the term of this patent is extended or adjusted under 35 U.S.C. 154(b) by 89 days.

(21) Appl. No.: 16/557,722

(22) Filed: Aug. 30, 2019

Related U.S. Application Data

(63) Continuation-in-part of application No. 15/980,508, filed on May 15, 2018, now Pat. No. 10,538,298.

(60) Provisional application No. 62/644,951, filed on Mar. 19, 2018.

(51) Int. Cl.
*B63B 32/00* (2020.01)
*B63B 32/40* (2020.01)
*B63B 32/60* (2020.01)

(52) U.S. Cl.
CPC ..... *B63B 32/45* (2020.02); *B63B 32/60* (2020.02)

(58) Field of Classification Search
CPC ..... B63B 32/45; B63B 32/60; B63B 32/00
See application file for complete search history.

(56) References Cited

U.S. PATENT DOCUMENTS

| | | | | |
|---|---|---|---|---|
| 10,130,836 | B2 * | 11/2018 | Madion | A63B 23/0211 |
| 10,538,298 | B1 * | 1/2020 | Blocker | B63B 32/77 |
| 2002/0167136 | A1 | 11/2002 | Lehr et al. | |
| 2009/0270001 | A1 | 10/2009 | Crispin | |
| 2013/0274078 | A1 | 10/2013 | Andrews | |
| 2013/0283541 | A1 | 10/2013 | Cridlebaugh | |
| 2013/0344757 | A1 | 12/2013 | Wojcik | |

FOREIGN PATENT DOCUMENTS

| | | |
|---|---|---|
| WO | WO2016151318 | 9/2016 |

* cited by examiner

*Primary Examiner* — Stephen P Avila
(74) *Attorney, Agent, or Firm* — Clayton Howarth, P.C.

(57) ABSTRACT

An apparatus and method for decreasing the difficulty of executing a "pop-up" maneuver on a water sport board, such as a surfboard, is disclosed. Said apparatus consists of either one or two devices attached to the surfboard at the location where a user places his hands to execute the pop-up maneuver. Said devices move the user's hands away from the deck of the surfboard, creating more space between the surfer and the board during the pop-up maneuver, facilitating the user to swing the user into position and execute the pop-up maneuver.

24 Claims, 11 Drawing Sheets

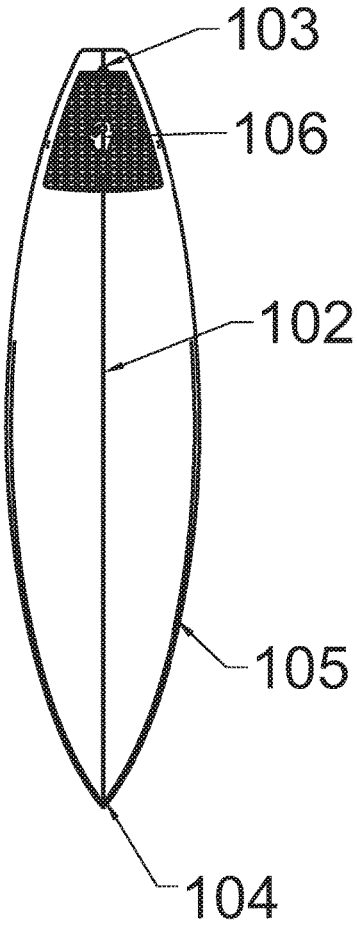
FIG 1A
(Prior Art)
FIG 1
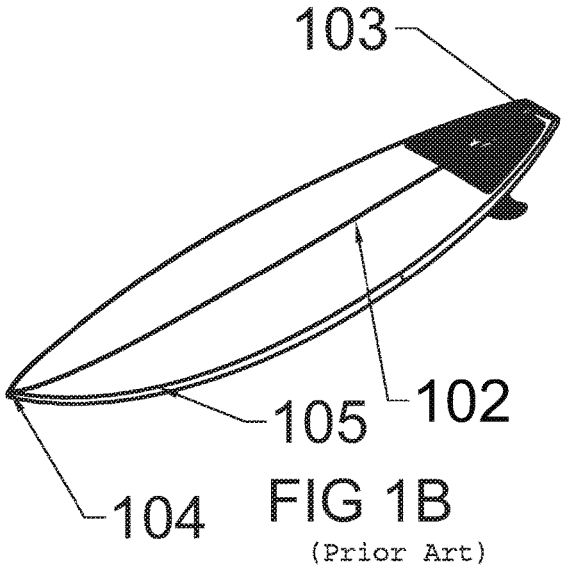
FIG 1B
(Prior Art)
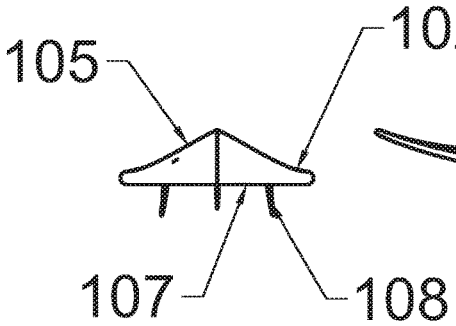
FIG 1C
(Prior Art)
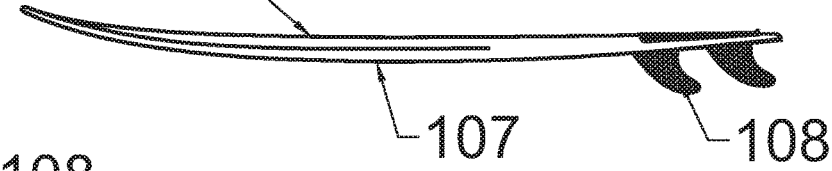
FIG 1D
(Prior Art)

FIG 2
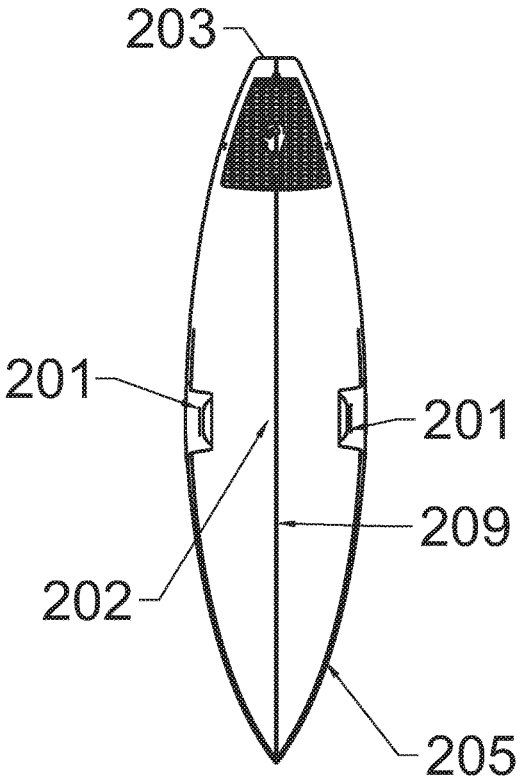
FIG 2A
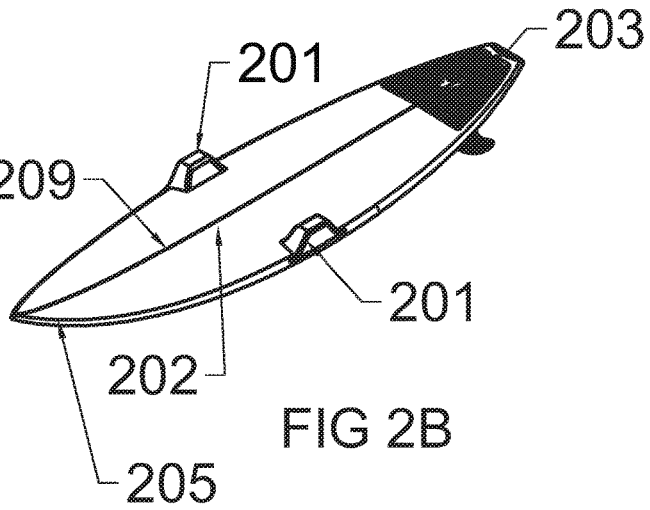
FIG 2B
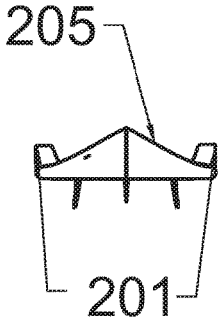
FIG 2C

FIG 5
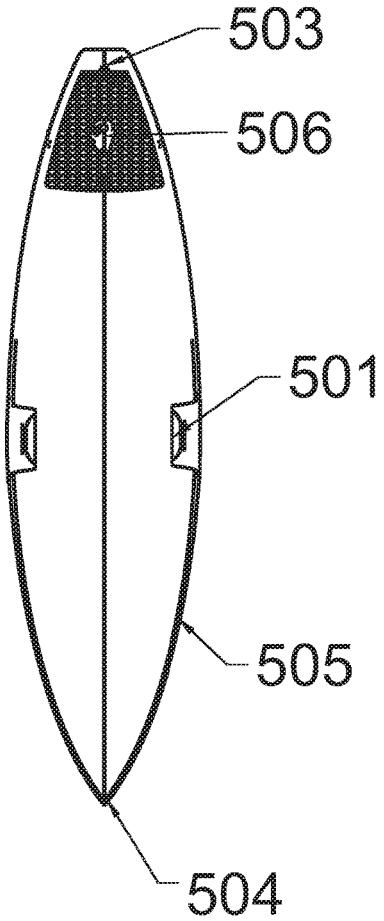
FIG 5A
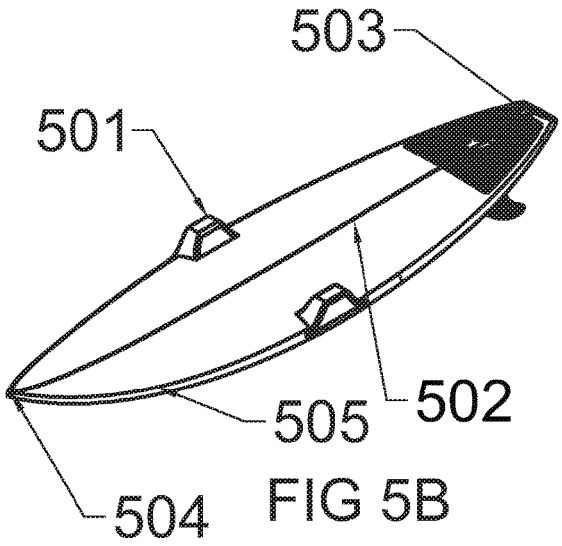
FIG 5B
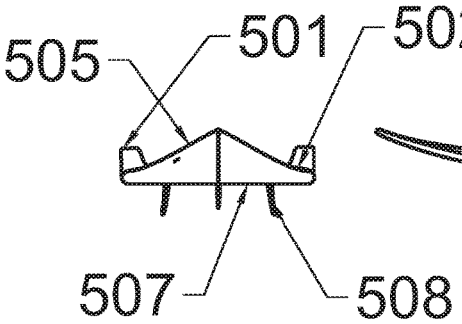
FIG 5C
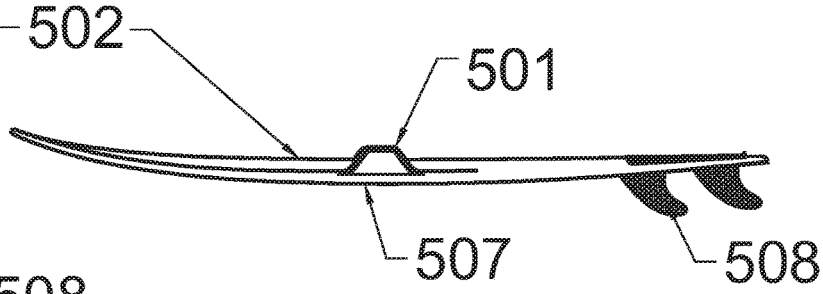
FIG 5D

FIG 6
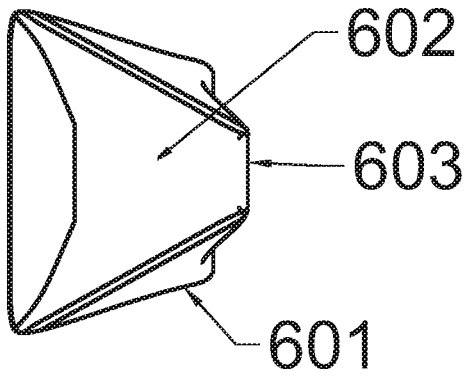
FIG 6A
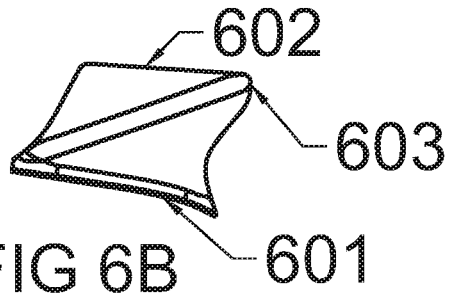
FIG 6B

APPARATUS AND METHOD TO AID WATER SPORT BOARD MANEUVERS

CROSS-REFERENCE TO RELATED APPLICATIONS

This application is a continuation in part of U.S. patent application Ser. No. 15/980,508, filed May 15, 2018, which claims the benefit of U.S. Provisional Patent Application No. 62/644,951, filed Mar. 19, 2018. Both of these referenced applications are hereby incorporated by reference herein in its entirety, including but not limited to those portions that specifically appear hereinafter, the incorporation by reference being made with the following exception: In the event that any portion of the above-referenced applications are inconsistent with this application, this application supersedes said above-referenced applications.

STATEMENT REGARDING FEDERALLY SPONSORED RESEARCH AND DEVELOPMENT

Not Applicable.

BACKGROUND

This disclosure relates generally to the field of board design and the practice of surfing and other water board sports. In particular, it relates to attachments or modifications to the deck of boards that assist the user in going from a prone paddling position to a stand-up riding position while catching a wave.

Surfing is a popular surface water sport where the user (surfer) is carried across the surface of a breaking wave while standing on a board. Surfing requires the surfer to have a combination of balance, strength and dexterity, such skills thereby limiting those that are able to excel in the sport.

Surfing can be broken down into several skill sets: paddling strength, wave timing, take-off positioning, quick pop-up from the prone paddling to the standing position on the surfboard and balance to execute surfing maneuvers while riding the wave.

For many, the most challenging aspect of surfing is the successful execution of a "pop-up" maneuver. The pop-up maneuver is the motion where a surfer goes from being prone on a surfboard to a stand-up position all in one motion. In context, this is done as a surfer attempts to catch a wave. While paddling in the prone position on the surfboard to match the speed of an approaching wave, the surfer must quickly stand up the moment he/she feels the push of the wave behind him/her in order to then ride the wave.

Traditionally, the surfing pop-up maneuver is defined by executing the following steps: 1. A surfer places her hands flat on the surfboard adjacent to the bottom of her rib cage; 2. The surfer pushes her chest off the surfboard with her pelvis and upper thighs still in contact with the surfboard; 3. Without relying on her knees and while keeping her hands planted on the surfboard, the surfer brings her front foot forward swinging under her body like a pendulum to approximately where her hands are located; and, 4. The surfer allows her body to twist so that her body is sideways on the surfboard with her feet spread but centered and parallel to the longitudinal midline of the surfboard. This pop-up maneuver was developed by surfers as a way for the surfer to stand up on their board while maintaining control and balance riding down the face of a wave.

Surfing a wave can be performed on various equipment including longboards, shortboards, funboards, stand-up paddle boards, bodyboards, wave skis, skimboards, kneeboards, kayaks, inflatables and surf mats, to name a few. This discussion is limited to those surfing styles that require the surfer to execute a pop-up maneuver to ride the wave. This would include the use of longboards (surfboards greater than 9 feet long), shortboards (surfboards less than 7 feet long) and the midsize funboards (surfboards between 7 and 9 feet long), but other water sports boards may also benefit from the present disclosure.

Originally, the surfboards of the 1940s were made of solid wood. In the early 1950s, lighter balsa wood surfboards were created which dramatically increased maneuverability when riding a wave. Traditional modern surfboards are made of fiberglass foam (PU), with fiberglass cloth, and polyester resin (PE). An emerging board material is epoxy resin and expanded polystyrene foam (EPS) which is both stronger and lighter than the traditional PU/PE surfboard. Some even newer designs are using carbon fiber and variable-flex composites into the construction. Also, in recent years, there has been an increase in soft surfboards of all shapes and sizes that have a core constructed of expanded polystyrene covered by a soft foam water tight skin. The popularity of these soft surfboards is growing due to their comfort, ease of use, durability and/or lower price point.

The sport of surfing, once restricted to coastlines, is now expanding into markets far away from oceans. Wake surfing and river surfing are both relatively newer sports that now allow participants to experience the sensation of surfing far away from the coast. Furthermore, recent advancements in artificial wave technologies now allow surfers to surf ocean like waves at man-made surf parks that are beginning to dot inland locations worldwide. With more and more people living in closer proximity to surfing locations, the surfing market is currently experiencing strong growth. These new entrants into the sport of surfing often find the sport incredibly daunting and challenging for the above mentioned reasons. Beginner surfers are looking for any advantage they may gain as they look to advance their skills in the sport.

A number of additions to boards have been proposed, such as methods to propel those boards more quickly, as well as alternatives to surfing, which may attach a device to the board. However, none of these devices are designed to be used when riding a wave to assist in the fast pop-up maneuver required in surfing.

SUMMARY OF THE DISCLOSURE

The present disclosure comprises a novel apparatus that accommodates execution of a surfer's "pop-up" maneuver. The apparatus, either as a single device or two disconnected devices, is attached as a retrofitted embodiment to the deck of a surfboard to assist the surfer in executing the pop-up maneuver. The attached devices are secured to the surfboard directly under where the surfer's hands would be at the time of a pop-up execution. The apparatus results in creating distance between the rider's planted hands and the deck of the surfboard, thereby creating additional space between the rider's upper chest and the surfboard deck facilitating easier lower body pull through. The devices could also be incorporated into the construction of the surfboard functioning to create distance from the surfer's planted hands and the primary plane of the surfboard deck.

BRIEF DESCRIPTION OF THE DRAWINGS

Some embodiments of the present disclosure are illustrated as examples and the scope of the present disclosure is not limited by the figures in the accompanying drawings, in which like references may indicate similar elements and in which:

FIGS. 1A-D depict one example of a standard surfboard without any novel modifications.

FIGS. 2A-C depict one example of a standard surfboard with one example of a retrofitted apparatus according to various embodiments described herein.

FIGS. 5A-D depict another embodiment of the novel surfboard.

FIGS. 6A-B depict two views of a third embodiment of an apparatus which can be retrofitted onto a surfboard.

DETAILED DESCRIPTION

Figure 3A:
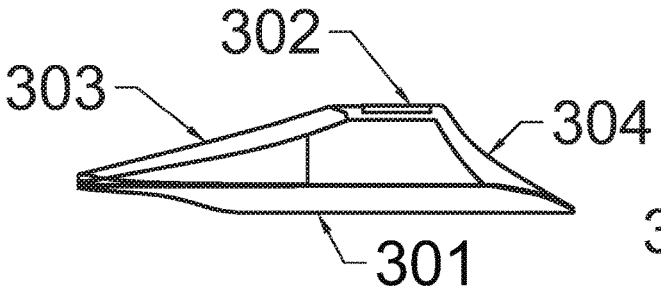
FIGS. 3A-D depict three views of an apparatus which is retrofitted onto a surfboard as shown in FIGS. 2A-C.
Figure 3B:
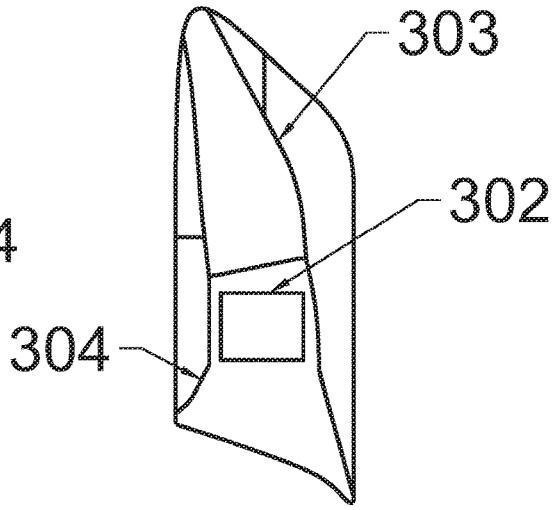

For the purposes of promoting an understanding of the principles in accordance with this disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the illustrative devices, systems, processes and methods will be disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular illustrative embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a", "an", and "the" include plural referents unless the context clearly dictates otherwise.

As used herein, the terms "comprising," "including," "containing," "characterized by," "having" and grammatical equivalents thereof are inclusive or open-ended terms that do not exclude additional, unrecited elements or method steps.

For convenience in describing the method and use of the current disclosure, singular masculine or feminine pronouns have been used to describe the person executing the methods described. It is to be understood that no limitation of the invention to use by one gender or the other is intended by such use.

In describing the embodiments of this disclosure, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps or applications in an unnecessary fashion. Nevertheless, the specification and claims should be read with the understanding that such combinations are entirely within the scope of the claims.

New apparatus and methods for assisting a surfer in executing a pop-up maneuver are disclosed herein. In the following description, for purposes of explanation, numerous specific details are set forth in order to provide a thorough understanding of the present invention. It will be evident, however, to one skilled in the art that the present invention may be practiced without these specific details.

The present disclosure will now be described by referencing the appended figures representing preferred embodiments. FIGS. 1A-D depict one example of a standard surfboard without any novel modifications displayed to show a standard form. The term surfboard, as used herein, generally refers to longboards, shortboards, funboards, and other water sport boards where a user will generally stand, at least a portion of the time, on the board and where it is generally necessary to switch from the prone paddling position to the standing position. FIG. 1A depicts a top view of a standard surfboard, while FIG. 1C shows a view from the front and FIG. 1D shows a view from the side. FIG. 1B shows a view from diagonally front. Referring to FIGS. 1A-D, a surfboard comprises: a deck 102 originating at a tail 103 and extending to a nose 104; outer edges or rails 105 along the lateral margin on each side of said deck 102; traction pad 106 is adhered to said deck 102 near the tail 103 where a surfer's back foot would normally be placed when riding a wave; and, a bottom 107 opposing said deck 102 and including at least one fin 108.

FIGS. 2A-C depict one example of a standard surfboard that is retrofitted with a device 201 of the present disclosure, hereafter referred to as the device. FIG. 2A depicts a top view, FIG. 2C depicts a front view of the retrofitted surfboard, and FIG. 2B depicts a view from the top diagonal. Referring still to FIGS. 2A-2C, the device 201 is removably attached to the deck of a surfboard 202 prior to the intended use. The device may be attached by any appropriate means, including but not limited to adhesives, mechanical means such as screws, velcro, buckles, mechanical fasteners, all of which fall within the scope of a means for attaching. Moreover, any other structures appropriate to fastening the device to a board meant to travel in the water are also within the scope of a means for attaching. Any structure or materials which perform the same or equivalent functions as the before recited structures are intended to be deemed within the scope a means for attaching and within this disclosure. Any structure which allows the device to be removed from the board, as well as any structure to permanently attach the device to the board, are within the scope of a means for attaching.

Still referring to FIGS. 2A-C, the device can be one continuous device or two separate devices so as to create space just between the surfer's planted hands and the deck of the surfboard laterally near the rails 205 only. The center point of the device 201 is adhered to the deck 202 where the surfer's hands are placed at the moment of a pop-up maneuver. The device does not extend to the side of the board or go into the water on the side of the board, but is kept within the outline of the board itself so as to not affect the dynamics of the board. The surfer's body position at the moment of the pop-up maneuver is prone lying flat on the deck 202 with the legs close together centered and parallel to the stringer 209 pointing toward or extending over the tail 203 depending on board length. The device can be a simple block, and it extends from the board a distance which is sufficient to facilitate an easier pop-up maneuver as described below. In one illustrative embodiment this distance may be between one and four inches. In another illustrative embodiment the distance may also be between two and three inches.

In use, the surfer paddles to catch a wave in the standard known fashion. Once the push of the wave is felt, the surfer executes a pop-up maneuver. However, the surfer, rather than pushing off the deck of the surfboard, plants her hands on the top flat portion of the device and pushes her chest away from the deck 202 with her pelvis and upper thighs still in contact with the surfboard. Without relying on her knees and while keeping her hands planted on the top flat portion of the device, she brings her front foot forward swinging under her body like a pendulum centered on the stringer 209 between the retrofitted devices 201. Allowing her body to twist so that her body is sideways on the surfboard with her feet spread but centered and parallel to the longitudinal midline of the surfboard, she now rides the wave. In one embodiment, the device has a large enough flat surface on the top that the user can easily place her hands in a similar position as if she were performing a pop-up maneuver without the device attached.

Figure 3C:
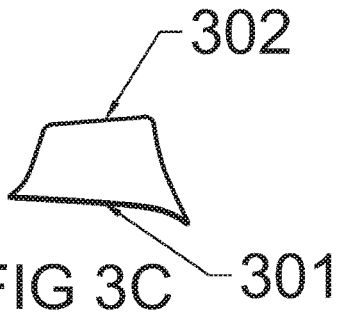

FIGS. 3A-D show another illustrative embodiment of the device. FIG. 3A shows a side view of the wedge-shaped device. In this embodiment, the device is a wedge shape approximately fourteen inches long and approximately five inches wide on the bottom of the wedge 301. The general shape can be seen from the top view of FIG. 3B. The device tapers to a top 302 which is approximately two-and-a-half inches long and approximately three inches wide. The wedge is approximately two inches tall on the interior side and approximately three inches tall on the exterior side to match the curvature of the average surfboard, as shown in FIG. 3C.

Figure 3D:
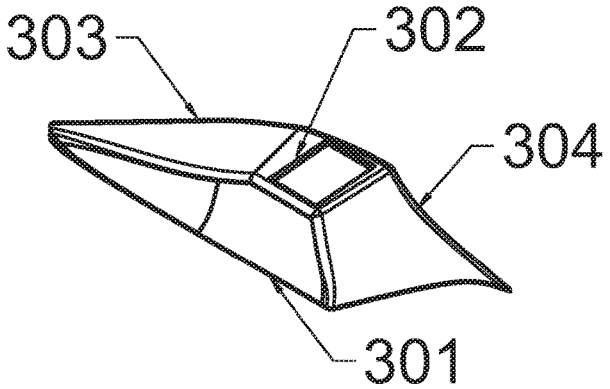

Still referring to FIGS. 3A-D, the apex of the top surface is located approximately three-fourths of the distance from the back to the front of the device, being located in the rear quarter of the device. As such, the slope in the front portion of the device 303 is much shallower than the slope in the rear portion of the device 304. FIG. 3D shows the wedge itself from an angle. The preferred construction of this embodiment of the device uses a solid, high-density EVA foam as the main construction, surrounded by a shell of lower-density EVA foam. In addition, a self adhesive is located on the bottom of the device with a paper backing that can be removed just prior to adhering the device to a surfboard deck. FIGS. 3A-D shows an apparatus to be placed on the right side of a board. A mirror image of the device would be placed on the left side of the board, and the devices would be used together.

Figure 4A:
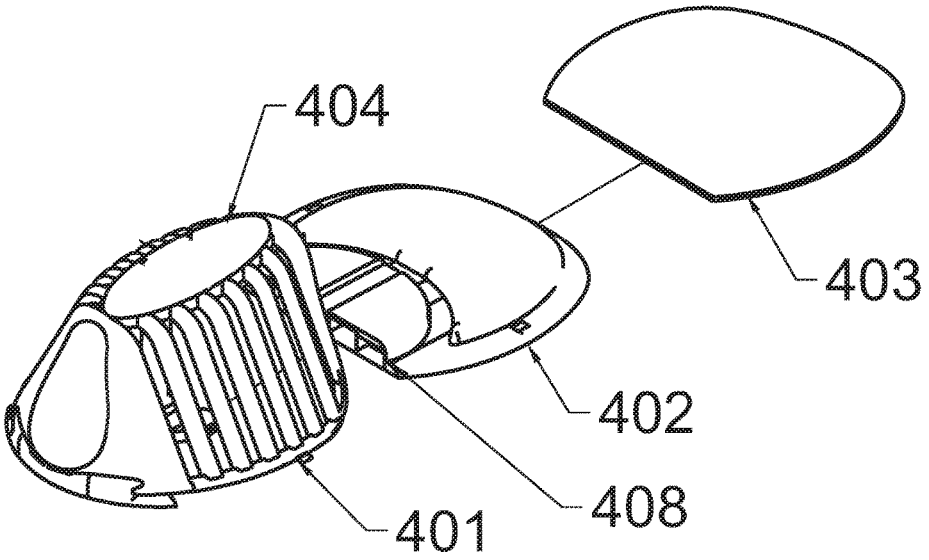
FIGS. 4A-E depict several views of a second embodiment of an apparatus which can be retrofitted onto a surfboard.
Figure 4B:
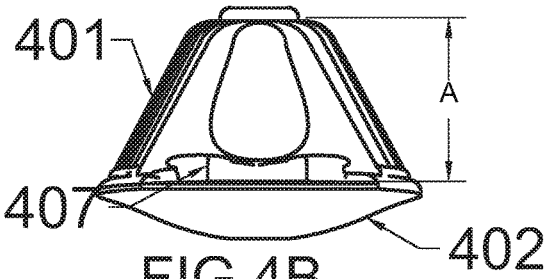
Figure 4C:
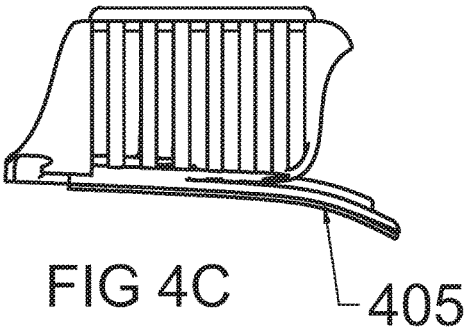
Figure 4D:
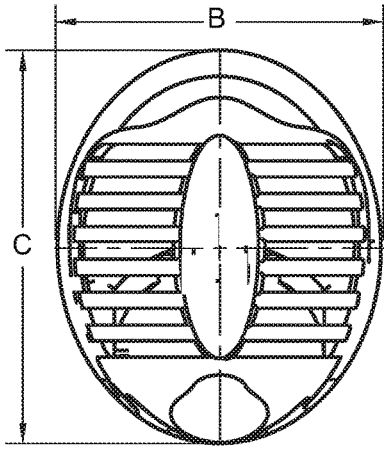

FIGS. 4A-E show another illustrative embodiment of the device, wherein the device is a dome shape. FIG. 4A shows that this embodiment of the device comprises two main portions, the dome 401 and the base 402. Both are ideally made of polycarbonate, but can also be constructed of any similar material with similar properties. FIG. 4B shows a side view of the device, showing that the dome 401 is approximately two inches tall (about 50 mm) at dimension A. FIG. 4D shows a top view of the apparatus, showing that the base is elliptical, with a first semi-major axis, of approximately 4.7 inches (about 120 mm), as shown at dimension C, and a second semi-major axis of approximately four inches (about 120 mm), as shown at dimension B. At the top surface, the dome is still approximately four-and-a-half inches along one semi-major axis, but has tapered to approximately one inch (about 25 mm) along the other semi-major axis. The top of the dome 404 is ideally adapted for gripping, in one embodiment by the application of a layer of EVA foam, embossed to provide traction and ease of gripping.

Figure 4E:
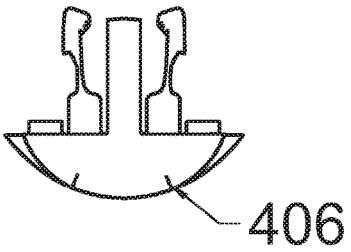

Still referring to FIGS. 4A-E, the dome 401 itself is connected to the base 402 by a side-release buckle 407, which allows the dome to be removed easily from the base. The dome has the insertable portion of the side-release buckle 407, while the base has a portion designed to receive the side-release buckle 408. In addition, a plug 406, shown in FIG. 4E is designed to be inserted into the base portion of the side release buckle 408 when the dome 401 is not being used. The plug can be inserted into the portion of the base designed to receive the side-release buckle and is itself a side-release buckle, but is not attached to anything else, simply filling in the space when the dome is not being used, or when the board is being transported. The base 402 is attached to the board by means of an adhesive bottom 403. The adhesive bottom can be a paper-backed self adhesive. Once the paper is removed, the base can be adhered to the board by the adhesive. In addition to the EVA foam on the top of the dome, there is also a layer of EVA foam on the top surface of the base for ease of gripping when the dome itself is not in use. FIG. 4C shows a side view of this illustrative embodiment, demonstrating the curvature of the bottom 405 which matches the curvature of a typical surfboard or other water sport board. To effectively use the apparatus, two would be attached to the surfboard, one each at the approximate location where a user's hands are placed to move from the prone position to the standing position.

FIGS. 5A-D show another illustrative embodiment of the present disclosure comprising a board of novel design, including a deck 502 originating at a tail 503 and extending to a nose 504; a bottom 507 opposing said deck; an outer edge, or rails, along the lateral margin on each side of said deck 505, between the deck 502 and the bottom 507; and at least one raised protrusion extending upward from the deck at a point approximately midway between the nose and tail 501, being in a location most convenient for a user's hands to be placed while executing a pop-up maneuver.

Still referring to FIGS. 5A-D, in this illustrative embodiment, the bottom includes at least one fin 508. There is a traction pad 506 affixed to the deck at the rear of the board. The board can desirably be a surfboard but other water sport boards may also benefit. The protrusion or protrusions 501 extend from the deck a sufficient distance to allow a user to place her hands on the protrusion in order to execute a pop-up maneuver, thus making the popup maneuver easier to execute. This distance may be in the range from approximately two inches to approximately three inches. The apparatus may have a single protrusion extending laterally across the surfboard, or as represented in FIGS. 5A-D it may have two separate protrusions so as to create space just between the surfer's planted hands and the deck of the surfboard laterally near the rails only. The protrusions are located where the surfer's hands are placed at the moment of a pop-up maneuver. The surfer's body position at the moment of the pop-up maneuver is prone lying flat on the deck with the legs close together centered and parallel to the stringer pointing toward or extending over the tail depending on board length. The surfer paddles to catch a wave in the standard known fashion. Once the push of the wave is felt, the surfer executes a pop-up maneuver. The surfer, however, rather than pushing off the deck of the surfboard, plants her hands on the top flat portion of the protrusions and pushes her chest away from the deck with her pelvis and upper thighs still in contact with the surfboard. Without relying on her knees and while keeping her hands planted on the top flat portion of the device, she brings her front foot forward swinging under her body like a pendulum centered on the stringer between the retrofitted devices. Allowing her body to twist so that her body is sideways on the surfboard with her feet spread but centered and parallel to the longitudinal midline of the surfboard, she now rides the wave.

FIGS. 6A-B show yet another illustrative embodiment of an apparatus which can be retrofitted to a board. FIG. 6A shows a top view of the device. In this embodiment, the device is approximately seven inches long and approximately four-and-a-quarter inches wide on the bottom of the apparatus 601. The general shape can be seen from the top view of FIG. 6A. The apparatus tapers to a top 602 which is approximately one-and-a-half inches long and approximately three-and-a-half inches wide. In one embodiment the apparatus is approximately three inches tall on the exterior side and approximately two inches tall on the interior side to match the curvature of the average surfboard, as shown in FIG. 6B.

Still referring to FIGS. 6A-B, the top surface extends to an edge 603 slightly to the side from the bottom surface, making the width of the entire apparatus approximately five inches. This can be easily seen in the top view of FIG. 6A. The preferred construction of this embodiment of the device uses a solid, high-density EVA foam as the main construction, surrounded by a shell of lower-density EVA foam. In addition, a self adhesive can be located on the bottom of the device with a paper backing that can be removed just prior to adhering the device to a surfboard deck. FIGS. 6A-B show an apparatus to be placed on the right side of a board. A mirror image of the device would be placed on the left side of the board, and the devices are desirably used together.

Figure 7A:
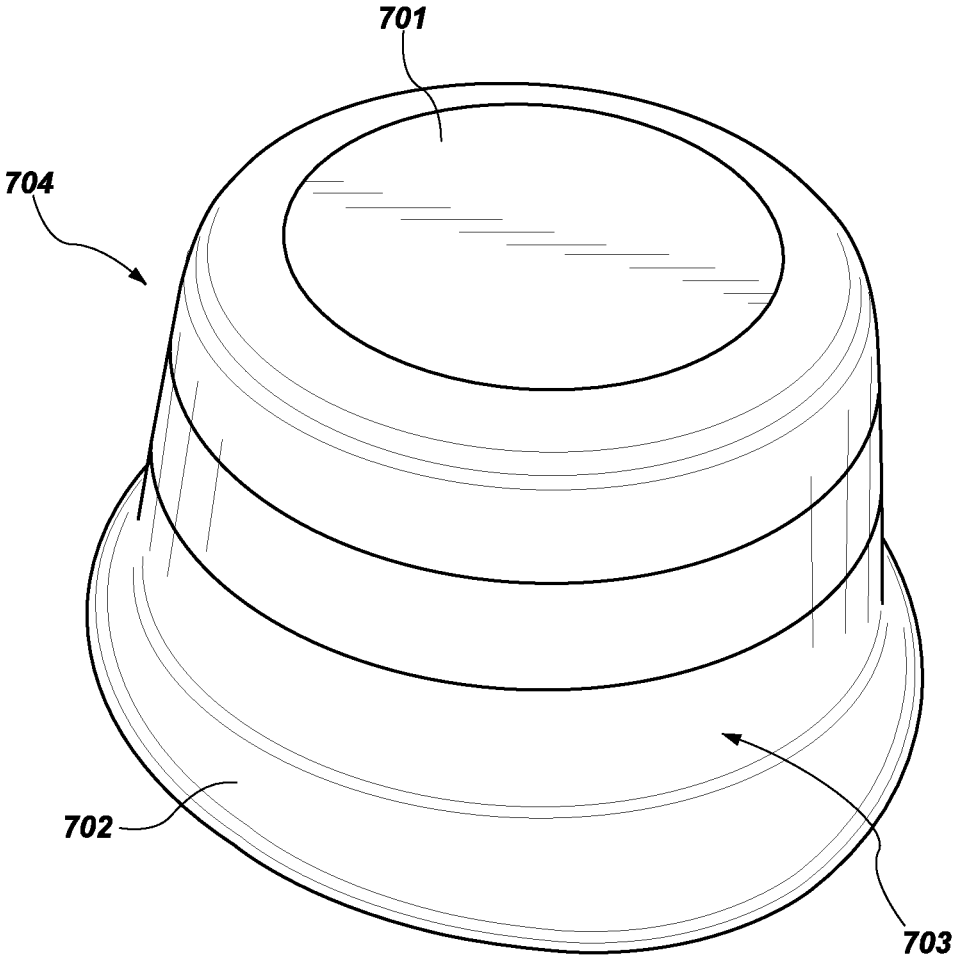
FIGS. 7A-D depict an additional embodiment of an apparatus which can be retrofitted onto a surfboard.
Figure 7B:
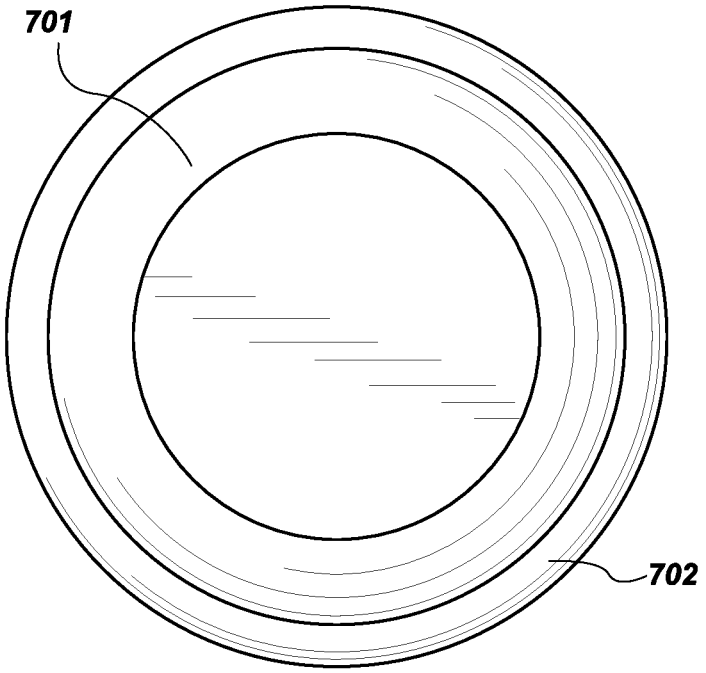
Figure 7C:
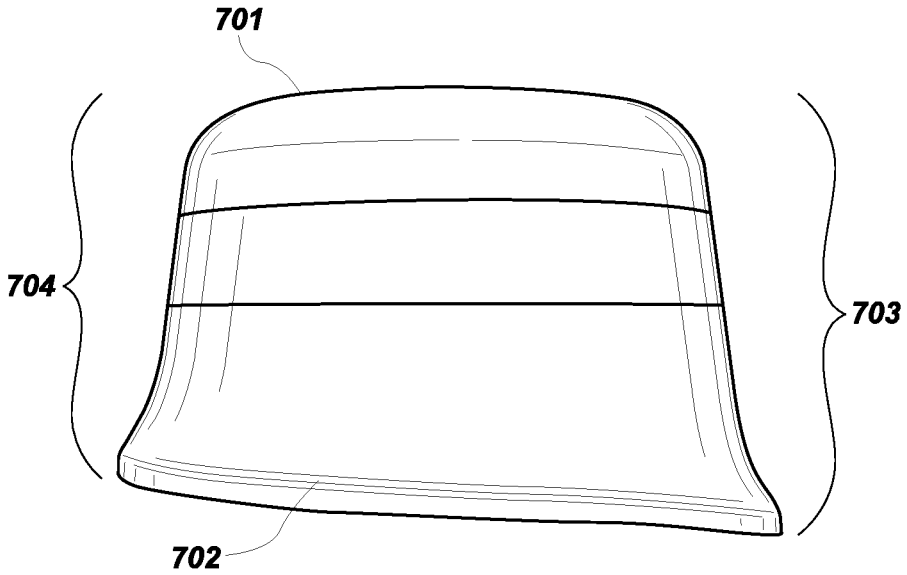

FIGS. 7A-D show an additional illustrative embodiment of an apparatus which can be retrofitted to a board. FIG. 7A shows a general view of this embodiment. FIG. 7B shows the top of this embodiment. In this embodiment the device is circular on the top and bottom faces. In one embodiment the top face 701 has a diameter of approximately 70 mm, while the bottom face 702 has a diameter of approximately 88 mm. FIG. 7C shows a side view of this embodiment of the invention. As can be seen, there are two distinct sides of the device with different thicknesses. The interior side 704 has a thickness of approximately 50 mm and when it is affixed to the surfboard, the interior side is towards the interior of the surfboard, closest to the middle line. The exterior side 703 has a thickness of 58 mm and when affixed to the surfboard is placed so that it is towards the outside of the board, closest to the edge of the board. The difference in the thickness on the two sides accounts for the slight slant of a surfboard which allows the top surface to be approximately level when placed on the surfboard.

Figure 7D:
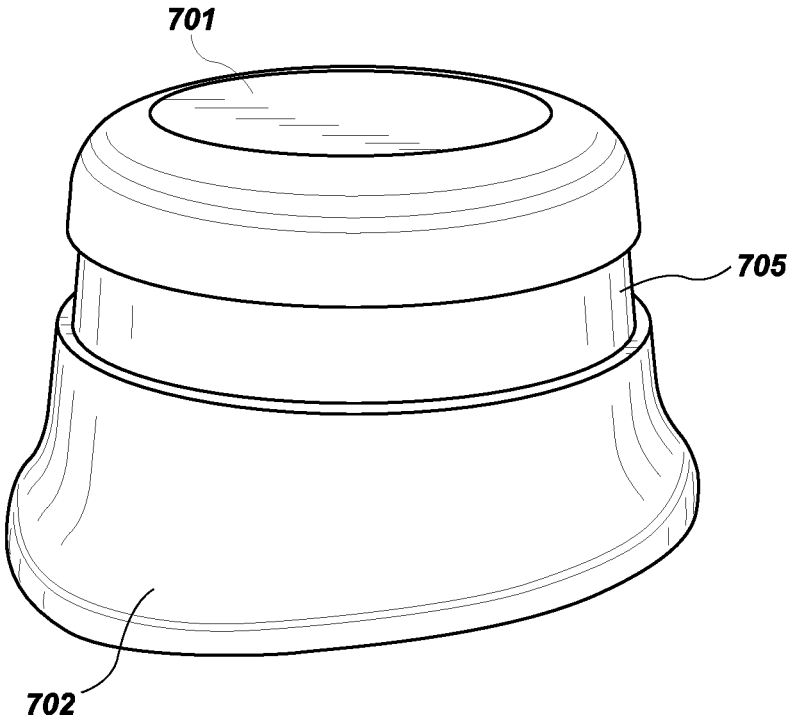

The preferred construction of this embodiment of the device is of a high-density EVA foam. In addition, a self-adhesive is located on the bottom of the device 702 with a paper backing that can be removed just prior to adhering the device to a surfboard deck in the position to best assist the user in making a pop-up maneuver. The device can also contain an indentation located approximately one third of the way down the device which is approximately 12 mm in width, structured around the circumference of the device. This indentation is sized to receive a silicone rubber band which can have a logo or identification on it. FIG. 7D shows the device with this indentation 705.

It will be appreciated that the embodiment illustrated in FIGS. 7A-D function and are used in a manner essentially the same as the other embodiments which are described herein. Those skilled in the art will appreciate the particular benefits which accrue from the use of the different illustrative embodiments described in detail herein as well as variations thereof.

Figure 8A:
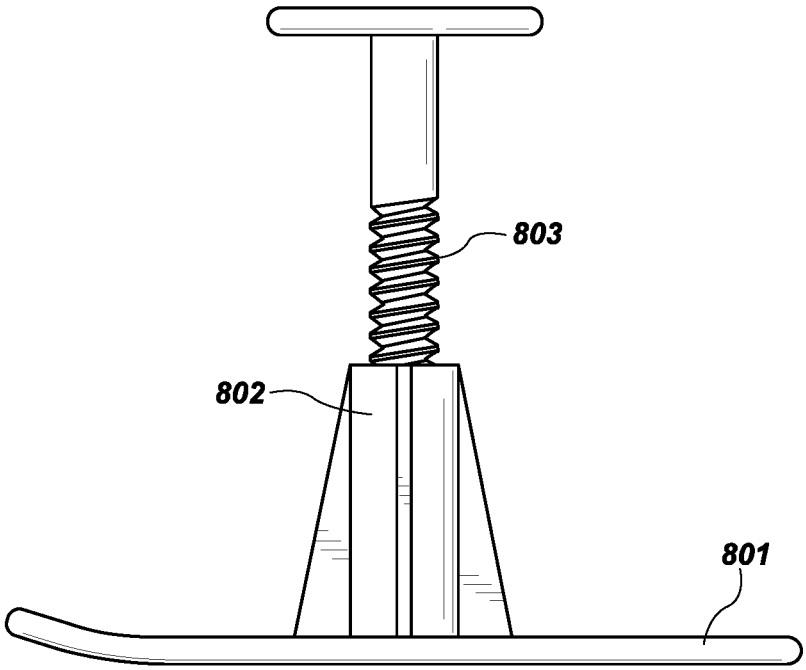
FIGS. 8A-B depict a mounting pad attachable to a soft-top surfboard which allows the embodiment represented in FIGS. 7A-D to be attached to a soft-top surfboard.
Figure 8B:
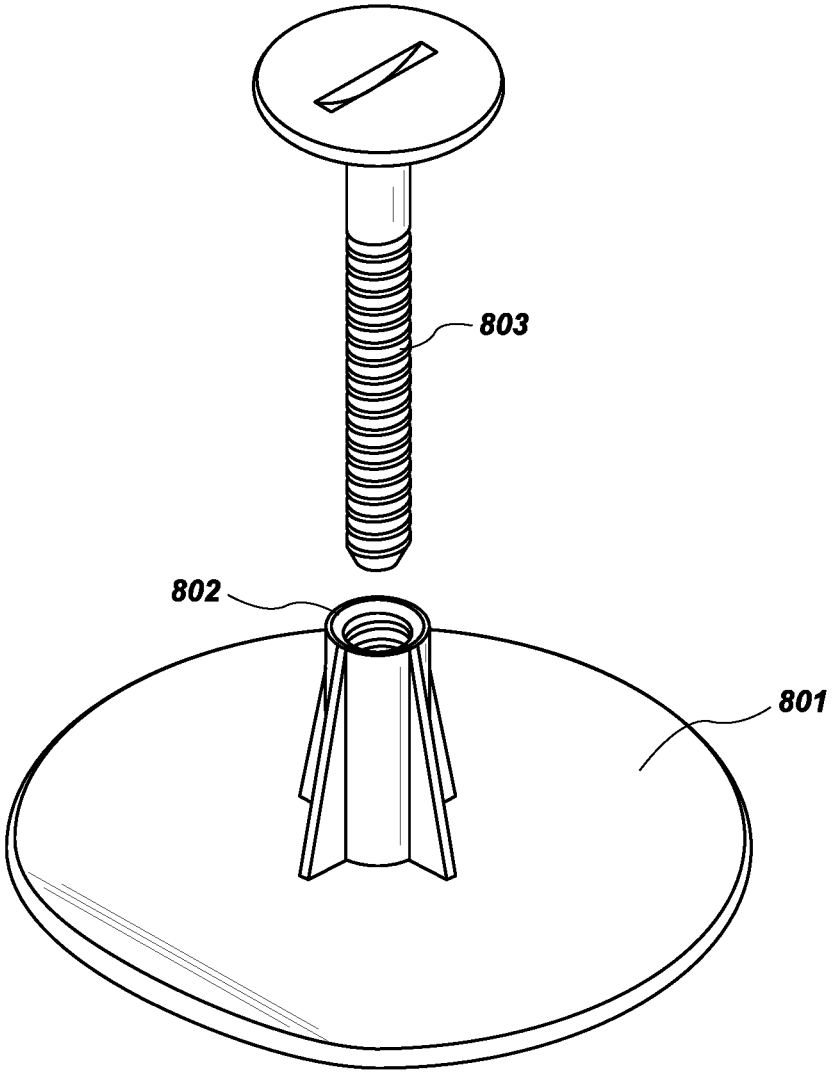

An additional embodiment includes a mounting device designed to allow the device to be attached to a soft top surfboard, as described above, and the additional embodiment represented in FIGS. 8A-8B. In general, adhesives do not adhere well to the surface of a soft-top board. As such, an alternative method of attaching the device to a soft-top board. The device to attach to the soft-top board comprises a custom molded plastic plate and screw is provided as represented in FIGS. 8A-B. The mounting device comprises two parts, a screw end 803 and a receiver end 802. FIG. 8A shows the mounting device with the screw end 803 and receiver end 802 connected. FIG. 8B shows the screw end 803 and receiver end 802 disconnected from each other. The receiver end 802 has a mounting plate 801 the which can be the same diameter the apparatus to be attached to the board, for example the apparatus illustrated in FIGS. 7A-D. In the embodiment illustrated in FIGS. 8A-B, this structure has a diameter of approximately 88 mm, to match one illustrated diameter of the bottom face of the apparatus illustrated in FIGS. 7A-D. The receiver end also comprises a structure to receive the screw end.

To mount the device on a surfboard using the embodiment of FIGS. 8A-B, a hole can be drilled through the soft top surfboard. The receiving end 802 is inserted into the whole with the plate 801 on top of the surfboard in the position where the device is to be mounted. The screw end 803 is then attached from the bottom of the board to secure the mounting device to the board. Then the device is attached to the mounting plate 801 using the adhesive on the bottom, which can be the same adhesive which can be used if the apparatus were being attached to a hard-top surfboard.

While preferred materials for the devices described above have specified, the fabrication of the structures described herein are not limited by these materials. Wood, plastics, foam, rubber, fiberglass, metal alloys, carbon fiber, aluminum and other material may comprise some or all of the elements of the surfboard pop-up assist devices and apparatus in various embodiments of the present disclosure.

Although the present disclosure has been illustrated and described reference to illustrative embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An apparatus capable of being removably affixed to a water sport board at a point where the user places her hands to assist the user in standing up, the board comprising a deck originating at a tail and extending to a nose; a bottom opposing said deck; an outer edge, or rail, along the lateral margin on each side of said board between the deck and the bottom; said apparatus comprising:

a circular top surface being adapted for supporting a user as the user pushes against it creating distance between the user and the board as the user moves from a first prone position to a second substantially standing position;

a circular bottom surface located opposite the top surface, at a distance which provides sufficient additional space between the user's hands and the deck of the board to facilitate the user swinging the user's feet underneath the user's body as the user moves from the first prone position to the second substantially standing position;

an interconnecting structure adapted for connecting the top surface to the bottom surface; said top surface, bottom surface, and interconnecting structure forming a support; and, means for attaching said support to the board.

2. The apparatus of claim 1 wherein the board is a surfboard.

3. The apparatus of claim 1 wherein the diameter of the top surface is approximately 70 mm.

4. The apparatus of claim 1 wherein the diameter of the bottom surface is approximately 88 mm.

5. The apparatus of claim 1 wherein the thickness of the apparatus is approximately 50 mm.

6. The apparatus of claim 1 wherein the apparatus additionally has an interior side and an exterior/side, wherein the exterior side has a thickness of approximately 58 mm and the interior side has a thickness of approximately 50 mm.

7. The apparatus of claim 1 wherein the means for affixing the device to a surfboard is an adhesive pad.

8. The apparatus of claim 1 wherein the means for affixing the device for a surfboard is a mounting device designed for use with a soft-top surfboard and an adhesive pad.

9. The apparatus of claim 8 wherein the mounting device comprises a screw end and a receiver end, the screw end comprising a screw which can be attached to soft-top surfboard by drilling a hole and attaching the receiver end, said receiver end comprising at least a mounting plate of the same size as the bottom surface of the apparatus, allowing the adhesive to be attached to the mounting plate.

10. The apparatus of claim 1 wherein the apparatus is formed out of EVA foam.

11. An apparatus capable of being removably affixed to a water sport board at a point where the user places her hands to assist the user in standing up, the board comprising a deck originating at a tail and extending to a nose; a bottom opposing said deck; an outer edge, or rail, along the lateral margin on each side of said board between the deck and the bottom; said apparatus comprising:

a circular top surface being adapted for supporting a user as the user pushes against it creating distance between the user and the board as the user moves from a first prone position to a second substantially standing position;

a circular bottom surface located opposite the top surface, at a distance which provides sufficient additional space between the user's hands and the deck of the board to facilitate the user swinging the user's feet underneath the user's body as the user moves from the first prone position to the second substantially standing position;

an interconnecting structure adapted for connecting the top surface to the bottom surface; said top surface, bottom surface, and interconnecting structure forming a support; and, means for attaching said support to the board.

12. The apparatus of claim 11 wherein the board is a surfboard.

13. The apparatus of claim 11 wherein the diameter of the top surface is approximately 70 mm.

14. The apparatus of claim 11 wherein the diameter of the bottom surface is approximately 88 mm.

15. The apparatus of claim 11 wherein the thickness of the apparatus is approximately 50 mm.

16. The apparatus of claim 11 wherein the apparatus additionally has an interior side and an exterior side, wherein the exterior side has a thickness of approximately 58 mm and the interior side has a thickness of approximately 50 mm.

17. The apparatus of claim 11 wherein the means for affixing the device to a surfboard is an adhesive pad.

18. The apparatus of claim 11 wherein the means for affixing the device for a surfboard is a mounting device designed for use with a soft-top surfboard and an adhesive pad.

19. The apparatus of claim 18 wherein the mounting device comprises a screw end and a receiver end, the screw end comprising a screw which can be attached to soft-top surfboard by drilling a hole and attaching the receiver end, said receiver end comprising at least a mounting plate of the same size as the bottom surface of the apparatus, allowing the adhesive to be attached to the mounting plate.

20. The apparatus of claim 11 wherein the apparatus is constructed out of high-density EVA foam.

21. A method for easing the difficulty of a user moving from a first prone position to a second substantially standing position while performing a pop up maneuver while riding a surfboard on the water, said method comprising;

providing a pair of devices extending from the deck, said device or pair of devices being distinct from the board and the rails of the board, wherein said devices are circular knobs with a diameter of between approximately 70 mm and approximately 88 mm;

placing the user's hands on the pair of devices extending from the deck of the board while keeping the user's hands firmly on the device or devices extending from the deck of the board, pushing the user's chest away from the deck with the user's pelvis and upper thighs still in contact with the board, using the device to create distance between the user's chest and the deck of the board;

while keeping the user's hands planted on the top portion of the device, bringing the user's front foot forward and allowing it to swing under the user's body;

while keeping the user's hands planted on the device extending from the board, allowing the user's body to twist so that the user's body is sideways on the board with the user's feet spread but centered and parallel to the longitudinal midline of the board; and, Releasing the user's hands from the device and moving to a substantially standing position.

22. The method of claim 21 wherein the devices have a thickness of between approximately 50 and approximately 58 mm.

23. The method of claim 21 wherein the devices are attached to the board with an adhesive.

24. The method of claim 21 wherein the user does not rely on the user's knees while moving from the first prone position to the second substantially standing position.

* * * * *